United States Patent [19]

Schröcksnadel

[11] 3,965,596

[45] June 29, 1976

[54] IMPROVEMENTS IN OR RELATING TO A MARKING SYSTEM

[76] Inventor: Peter Schröcksnadel, Etrichgasse 18a, 6020 Innsbruck, Austria

[22] Filed: May 1, 1975

[21] Appl. No.: 573,515

[52] U.S. Cl. ..... 40/125 N; 116/63 R; 404/9

[51] Int. Cl.[2] ..... G09F 19/22

[58] Field of Search ..... 40/125 N, 125 R, 145 R, 40/145 A, 125 H; 116/63 R, 63 P, 63 C; 404/9, 12

[56] References Cited

UNITED STATES PATENTS

| | | | |
|---|---|---|---|
| 270,223 | 1/1883 | Ingus | 40/125 N |
| 2,318,722 | 5/1943 | Smith et al. | 404/9 X |
| 2,887,930 | 5/1959 | Zoffmann | 116/63 P X |
| 3,312,156 | 4/1967 | Pellowski | 116/63 P X |
| 3,768,383 | 10/1973 | Tucker | 116/63 R |

*Primary Examiner*—Hugh R. Chamblee
*Assistant Examiner*—John F. Pitrelli
*Attorney, Agent, or Firm*—Wenderoth, Lind & Ponack

[57] ABSTRACT

A marking system for ski runs or the like wherein a plurality of demarcation signs, each of preferably spherical shape and with two halves which are differently colored, are symmetrically arranged along the two edges of the run.

2 Claims, 2 Drawing Figures

IMPROVEMENTS IN OR RELATING TO A MARKING SYSTEM

BACKGROUND OF THE INVENTION

The invention relates to a marking system for ski runs and the like consisting of a plurality of demarcation signs arranged along the edges of the run.

Especially for ski runs it is usual to mark the course of the run by means of sign posts or signs fixed on poles or trees along the run. These signs indicate the approximate course of the run, and preferably also the standard and the length thereof. In good weather conditions this manner of marking ski runs is both sufficient and satisfactory.

In bad weather conditions, however, especially in fog or heavy snowfall this kind of marking system is not satisfactory, as a skier who is not familiar with the terrain can easily lose his way outside the run. Especially in high mountain regions above the tree line this deficiency can have fatal consequences, and there have already been a number of accidents with people injured and even dead. It could happen that skiers lost their way and came into slopes endangered by avalanches or fell over rock walls or into crevasses. The reasons for these accidents are that the distance between the single sign posts usually was too great and that it was impossible for the skier to find out on which side of the sign post the run passed.

Furthermore it is known for demarcation purposes of general type to use 3-dimensional signs of mainly conical form which can be easily distinguished from the surroundings because of their remarkable colouring, illumination or the like, whereby the signs used for one demarcation purpose were all of the same type.

For slalom competitions it is known to mark the course of the competitor competitor by poles, whereby the two poles which form a gate are always of the same colour.

The lateral delimitation poles for roads, i.e. snow poles which are planted in winter, also serve for the demarcation of the edge of the road, the course of the road being defined by the constant distance between each pair of poles opposite one another.

These last mentioned possibilities of demarcation, however, can not be transferred to ski runs, since the width of a run is by far larger than that of a road, and also since the width of a ski run varies constantly.

SUMMARY OF THE INVENTION

Therefore the object of the invention is to provide a demarcation system which clearly marks the exact course of the run and which cannot remain unnoticed even in very bad weather conditions.

According to the invention this is achieved by the fact that every one of the preferably spherical demarcation signs has two differently coloured halves, and that the imaginary colour separating plane of which is approximately vertical and parallel to the edge of the run, each pair of demarcation signs opposite one another at the two edges of the run being arranged symmetrically.

The course of a run is exactly indicated if the run is demarcated by means of the demarcation signs according to the invention. Even in thick fog a skier can easily find out that he is outside the run, e.g. on the left side thereof, when he sees at his right hand side the halves of the signs that are of a colour directed away from the run. The small distances between the single demarcation signs along the edge of the run permit the skier to ski from one sign to the next even in very poor light conditions without having to be afraid of getting off the run. As an example: the halves of the demarcation signs which are directed toward the run are of green colour, which means "go", while those directed away from the run are red or orange, which means "stop" or "danger".

As long as the skier is skiing on the run he can see green demarcation signs on both his sides. As soon as he has left the run at his right or at his left he sees the second half of a demarcation sign, which is of a different colour, e.g. red or orange.

The demarcation signs can be fixed on poles according to prior art systems or arranged directly on the ground where they are less exposed to the wind.

BRIEF DESCRIPTION OF THE DRAWINGS

The invention is described hereinafter with reference to the figures of the attached drawing, without however being limited to the specific embodiment represented.

DETAILED DESCRIPTION OF THE INVENTION

The run 1 is provided with a plurality of spherical demarcation signs 3 or 3' which are arranged at small distances from each other, e.g. 20 to 30 m, along both edges of the run 1. The demarcation signs 3 or 3' each have two differently coloured semispherical halves 4 and 4'. The halves 4' of the same colour of two opposite demarcation signs 3 or 3' face each other. In the embodiment according to FIG. 1 the demarcation signs 3 are arranged on poles, but it is also possible to arrange them directly on the ground as shown by 3' in FIG. 2.

Figure 1:
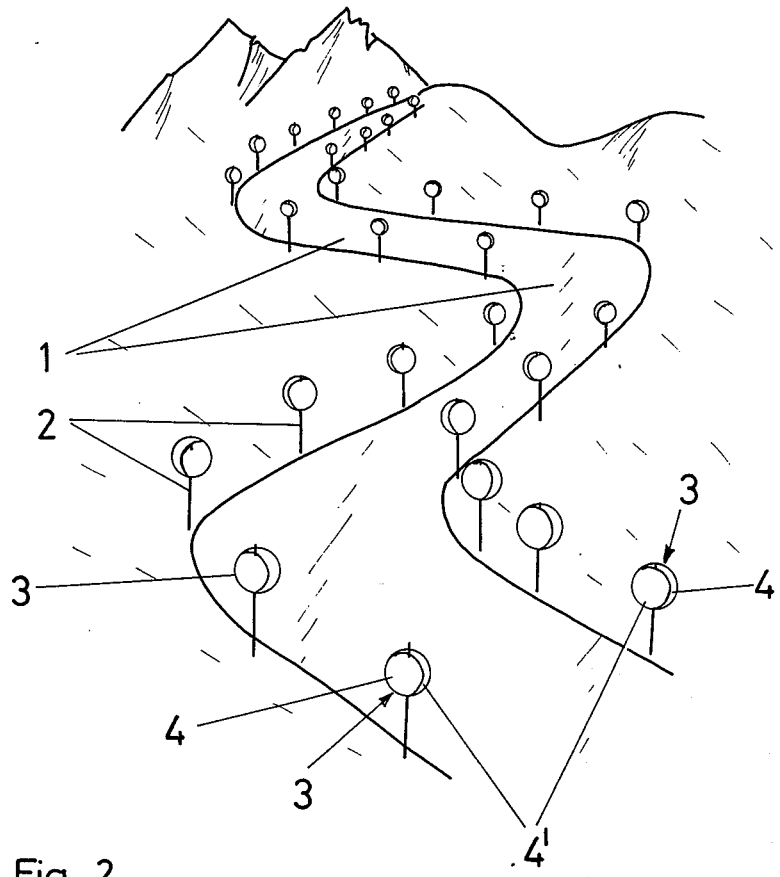
FIG. 1 is a perspective view representing the demarcation of a run by means of demarcation signs according to the invention.
Figure 2:
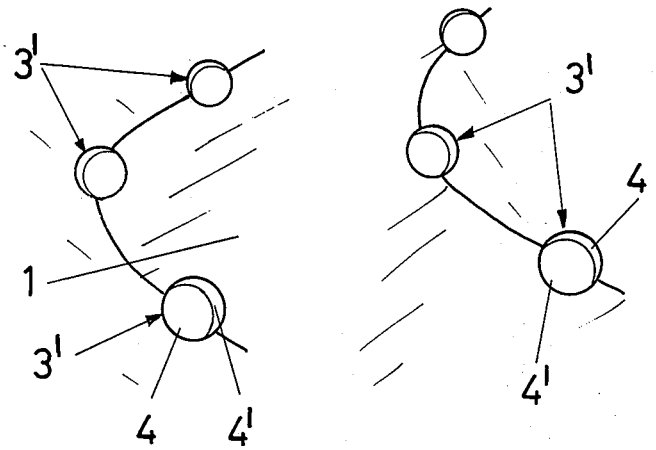
FIG. 2 is a perspective view representing a modified embodiment of the invention.

The embodiment according to FIG. 1 is specially advisable for the demarcation of ski runs, while the embodiment according to FIG. 2 is favourable for tracing the course for downhill competitions.

The use of the demarcation system according to the invention is not limited to ski runs and downhill courses, but it may also be used for demarcation in impracticable terrain, marshes and the like, or for other similar demarcation tasks.

What I claim is:

1. A marking system for the visual identification of an area such as a ski run or the like, said system comprising:

a plurality of demarcation signs symmetrically arranged in pairs along opposite edges of a run;

each said sign having a first half of a first color and a second half of a second color, the division between said first and second halves of each sign being substantially vertical, and extending in a plane substantially parallel to the run; and said signs of each said pair being positioned with respective similarly colored halves facing each other, whereby a person can readily determine whether he is inside or outside the run upon viewing a single sign.

2. The system claimed in claim 1, wherein each said sign is spherically shaped, and each said first and second halves are semispherically shaped.

* * * * *